US005404956A

United States Patent [19]

Bohlen et al.

[11] Patent Number: 5,404,956

[45] Date of Patent: Apr. 11, 1995

[54] HYDRAULIC SETTING TOOL AND METHOD OF USE

[75] Inventors: J. Tad Bohlen; Ricky D. Jacobi, both of Duncan; Donald R. Smith, Wilson; Donald F. Hushbeck, Duncan, all of Okla.; Seth B. Thomas, Missouri City, Tex.

[73] Assignee: Halliburton Company, Duncan, Okla.

[21] Appl. No.: 58,649

[22] Filed: May 7, 1993

[51] Int. Cl.[6] ..... E21B 33/129; E21B 23/06; E21B 34/12

[52] U.S. Cl. ..... 166/387; 166/120; 166/123; 166/128; 166/131; 166/143; 166/149

[58] Field of Search ..... 166/152, 151, 149, 143, 166/123, 120, 128, 131, 387

[56] References Cited

U.S. PATENT DOCUMENTS

| | | | |
|---|---|---|---|
| 2,624,412 | 1/1953 | Ragan | 166/120 |
| 3,556,220 | 1/1071 | Schwegman | 166/120 X |
| 4,151,875 | 5/1979 | Sullaway | 166/126 |
| 4,185,689 | 1/1980 | Harris | 166/133 |
| 4,436,149 | 3/1984 | Edwards | 166/120 |
| 4,441,552 | 4/1984 | Hamman | 166/133 |
| 4,516,634 | 5/1985 | Pitts | 166/120 |
| 4,665,992 | 5/1987 | Franc | 166/387 |
| 4,679,624 | 7/1987 | Harris et al. | 166/120 |
| 4,687,063 | 8/1987 | Gilbert | 166/382 |
| 4,688,634 | 8/1987 | Lustig et al. | 166/120 |
| 4,708,202 | 11/1987 | Sukup et al. | 166/123 |
| 4,708,208 | 11/1987 | Halbardier | 166/387 |
| 4,726,419 | 2/1988 | Zimkel | 166/120 X |
| 4,773,478 | 9/1988 | Streich | 166/120 |
| 4,823,881 | 4/1989 | Streich | 166/382 |

OTHER PUBLICATIONS

Halliburton Services Sales & Service Catalog No. 43 (1985), pp. 2561–2562.

Halliburton Services Manual, pp. IV-1–IV—39, dated Nov. 1, 1976; and pp. IV–40–IV–48 dated Apr. 15,1979.

*Primary Examiner*—Hoang C. Dang

*Attorney, Agent, or Firm*—Stephen R. Christian; Neal R. Kennedy

[57] ABSTRACT

A hydraulic setting tool for setting a packer with a sliding valve therein in an operating position in a well bore. The setting tool comprises an outer housing portion slidably disposed with respect to an inner mandrel portion. A piston is connected to the outer housing portion and slidable with respect to the inner portion. The piston is responsive to tubing pressure for setting the packer. A locking dog is provided for locking said piston against further movement after setting of the packer. An actuating mandrel forms a part of the inner mandrel portion and is adapted for engaging a valve in the packer. Longitudinal movement of the tool string allows selective opening and closing of the valve in the packer.

28 Claims, 9 Drawing Sheets

HYDRAULIC SETTING TOOL AND METHOD OF USE

BACKGROUND OF THE INVENTION

1. Field of the Invention

This invention relates to hydraulic setting tools for packers and bridge plugs, and more particularly, to a hydraulic setting tool that will set and operate a packer using hydraulic pressure only without manipulation of the tool string and operate a valve in the packer.

2. Description of the Prior Art

The Halliburton E-Z Drill SV® squeeze packer contains a pressure balanced sliding valve for control of fluid movement in the well. The valve in the packer may be opened or closed, as desired, before and after squeeze cementing.

The previously used mechanical setting tools require pipe rotation and reciprocation to set the Halliburton E-Z Drill SV® squeeze packer. This is undesirable in both shallow and horizontal wells. The hydraulic setting tool of the present invention does not require such pipe movement and is therefore applicable to shallow and horizontal wells.

With prior wireline setting tools, one trip is required into the hole with the wireline setting tool and another trip into the hole with tubing to operate the valve in the E-Z Drill SV® squeeze packer. With the hydraulic setting tool of the present invention, the wireline trip with the wireline setting tool is eliminated, thus saving time and reducing operating costs. The present setting tool is used to operate the packer valve.

Hydraulic setting tools for packers and bridge plugs are well known in the art. However, such prior art hydraulic packer and bridge plug setting tools are either complex in construction and/or operation or require the use of balls or plugs to be pumped through the tubing string for the actuation of the setting tool in response to hydraulic fluid pressure in either the tubing string or annulus between the tubing string and well casing in which the packer or bridge plug is being set.

The present invention eliminates any problems related to balls, darts or plugs in that such devices are not necessary because the present invention operates using only annulus and tubing pressure. It is also a much simpler apparatus than prior art setting tools.

SUMMARY OF THE INVENTION

The hydraulic setting tool of the present invention is adapted for use in setting a packer in a well bore, the packer having a fluid control valve therein. The hydraulic setting tool comprises hydraulic setting means for setting the packer in the well bore, mechanical locking means for preventing movement in the setting means after setting of the packer, and actuation means for actuating the valve in the packer after actuation of the locking means. The tool may also comprise pressure relief means for relieving fluid pressure in the setting means when the locking means is actuated.

In one embodiment, the hydraulic setting means comprises an outer portion, an inner portion such that an annulus is defined between the inner and outer portions, and setting piston means disposed in the annulus and connected to the outer portion for responding to pressure applied thereto, resulting in movement of the outer portion with respect to the inner portion. Shearing means may also be provided for shearably holding the outer portion in an initial position with respect to the inner portion.

The tool preferably further comprises bypass means for bypassing fluid through the tool as the tool and packer are run into a well bore. A hydraulic valve means is used for closing the bypass means in response to a well annulus pressure. A shearing means shearably holds the hydraulic valve means in an initial position with respect to the tool. The bypass valve means defines a differential area thereon, such that as pressure is applied to the differential area, a force is applied to the bypass valve tending to move it to a closed position. In the preferred embodiment, this pressure is well annulus pressure.

The present invention may also be said to include a method of setting a packer in a well bore comprising the steps of connecting a setting tool to the packer and positioning the setting tool and packer at a predetermined location in the well bore, applying tubing pressure to the setting tool for hydraulically setting the packer without manipulation of the tool string, longitudinally moving the tool string, after setting the packer, to mechanically lock the setting tool against further hydraulic actuation thereof, and longitudinally moving the tool string, after locking the setting tool, for selectively opening and closing a valve in the packer. The method may also comprise the step of, prior to hydraulically setting the packer, applying annulus pressure for closing a bypass valve on the setting tool.

Numerous objects and advantages of the present invention will become apparent as the following detailed description of the preferred embodiment is read in conjunction with the drawing which illustrate such embodiment.

DESCRIPTION OF THE PREFERRED EMBODIMENTS

First Embodiment

Figure 1A:
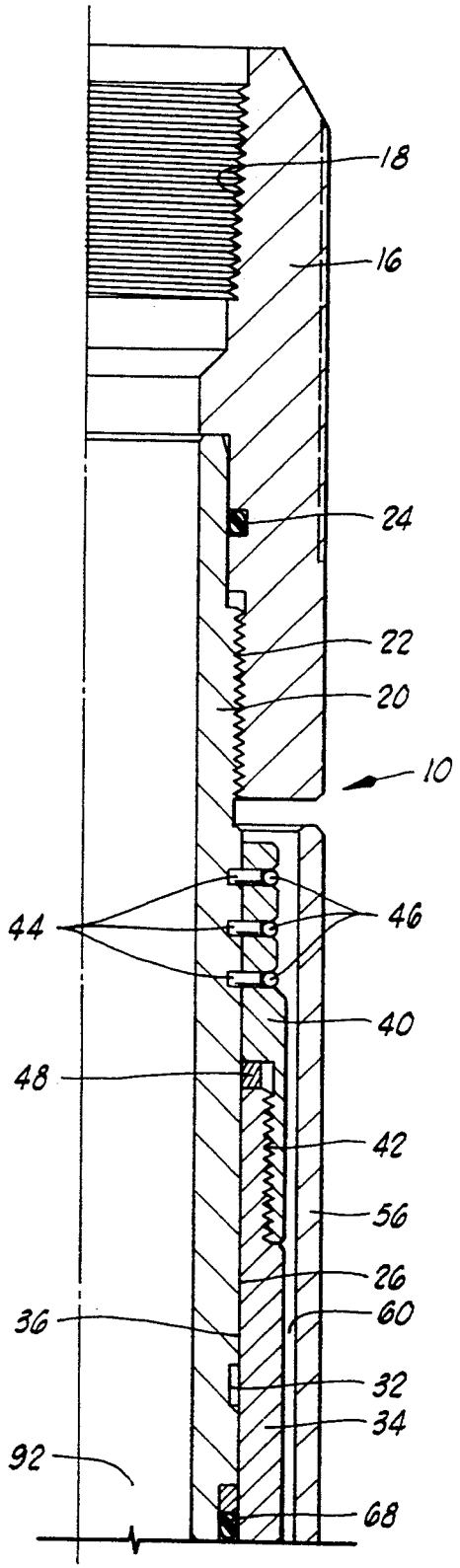
FIGS. 1A–1H show a first embodiment of the hydraulic setting tool of the present invention and also illustrate the setting tool in position connected to a packer for setting thereof.

Referring now to the drawings, and more particularly to FIGS. 1A–1H, a first embodiment of the hydraulic setting tool of the present invention is shown and generally designated by the numeral 10. Hydraulic setting tool 10 is used to set a packer, generally designated by the numeral 12, such as the Halliburton E-Z Drill SV® squeeze packer.

Referring now to FIG. 1A, at the upper end of first embodiment setting tool 10 is an upper adapter 16 having an internally threaded surface 18 adapted for connection to a tool string.

Upper adapter 16 is connected to a valve mandrel 20 at threaded connection 22. A sealing means, such as O-ring 24, provides sealing engagement between upper adapter 16 and valve mandrel 20.

Figure 1B:
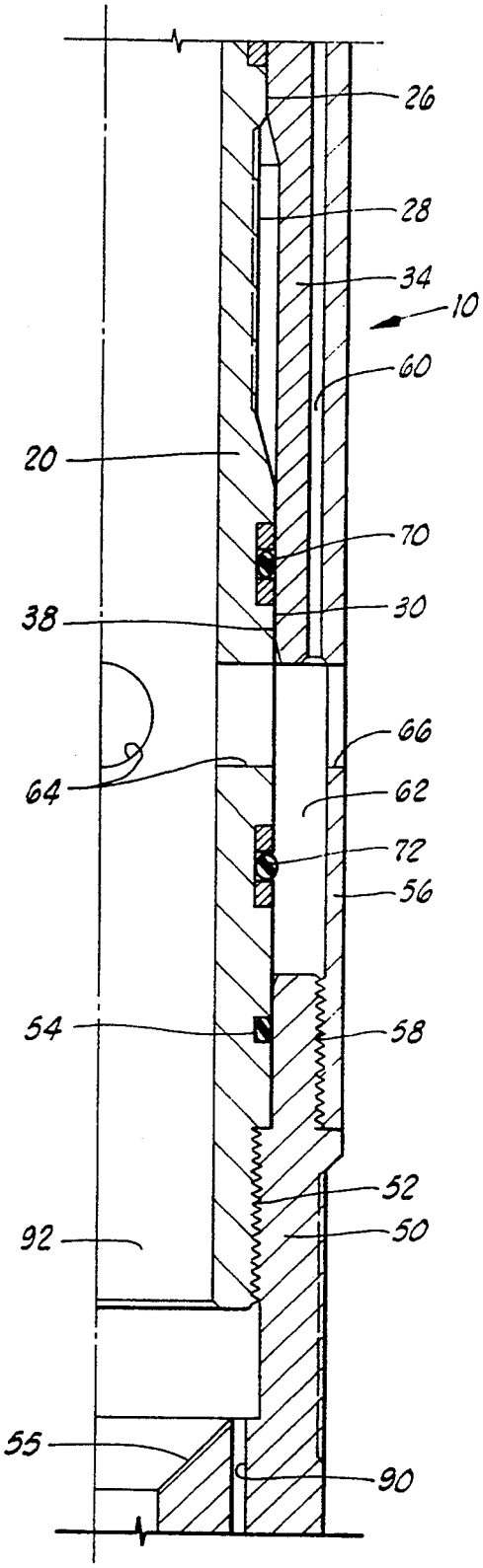

Valve mandrel 20 has a first outside diameter 26 with a recessed second outside diameter 28 therebelow, as seen in FIGS. 1A and 1B. Valve mandrel 20 has a larger third outside diameter 30. A groove 32 is defined in first outside diameter 26.

A bypass valve 34 is slidably disposed on valve mandrel 20 and has a first bore 36 slidably engaged with first outside diameter 26 of the valve mandrel. Valve mandrel 34 also has a second bore 38 in sliding engagement with third outside diameter 30 of valve mandrel 20, as seen in FIG. 1B.

The upper end of valve 34 is connected to a shear pin adapter 40 at threaded connection 42. A plurality of shear pins 44 extend through shear pin adapter 40 into valve mandrel 20, and it will be seen by those skilled in the art that valve 34 is thus shearably connected to the valve mandrel in the initial position shown in FIG. 1A. Shear pin retainer rings 46 are disposed outwardly of shear pins 44 to hold the shear pins in position. An inwardly biased locking dog or retainer ring 48 is disposed between valve 34 and shear pin adapter 40. As will be further described herein, locking dog 48 is adapted for engagement with groove 32 in valve mandrel 20 when valve 34 is closed.

Referring again to FIG. 1B, the lower end of valve mandrel 20 is attached to an upper housing 50 at threaded connection 52. A sealing means, such as O-ring 54, provides sealing engagement between upper housing 50 and valve mandrel 20. Upper housing 50 has a shoulder 55 therein.

Extending upwardly from upper housing 50 is a valve enclosure 56 which is connected to the upper housing at threaded connection 58. Valve enclosure 56 is spaced outwardly from valve 34 such that an annular volume 60 is defined therebetween.

A larger annular volume 62 is defined between valve enclosure 56 and the lower end of valve mandrel 20.

A plurality of mandrel bypass ports 64 are defined through the lower end of valve mandrel 20 and are in communication with annular volume 62. A corresponding plurality of enclosure bypass ports 66 are defined through valve enclosure 56 and are also in communication with annular volume 62. It will thus be seen by those skilled in the art that a well annulus defined between tool 10 and the well bore is in communication with mandrel bypass port 64 when the tool is in the initial position shown in FIGS. 1A–1H.

A sealing means, such as seal 68, provides sealing engagement between valve mandrel 20 and first bore 36 in valve 34, as shown in FIG. 1A. Another sealing means, such as seal 70, provides sealing engagement between valve mandrel 20 and second bore 38 in valve 34, as seen in FIG. 1B. Seal 70 is above mandrel bypass ports 64. Because of the sealing action of seals 68 and 70, and because of the size difference between first bore 36 and second bore 38 of valve 34, it will be seen that a differential area is defined between the first and second bores. Well annulus pressure applied to valve 34 thus imparts a net downward force across this differential area on valve 34. Initially, this downward force is overcome by shear pins 44 so that valve 34 does not move. A sufficient increase in well annulus pressure will cause valve 34 to be moved downwardly, as further described herein.

Valve mandrel 20 also carries a third sealing means, such as seal 72, which is disposed below mandrel bypass ports 64. In the initial position shown in the drawings, seal 72 is not active. However, after valve 34 is moved, seal 72 is adapted for sealing engagement with second bore 38 in the valve, as further described herein.

Figure 1C:
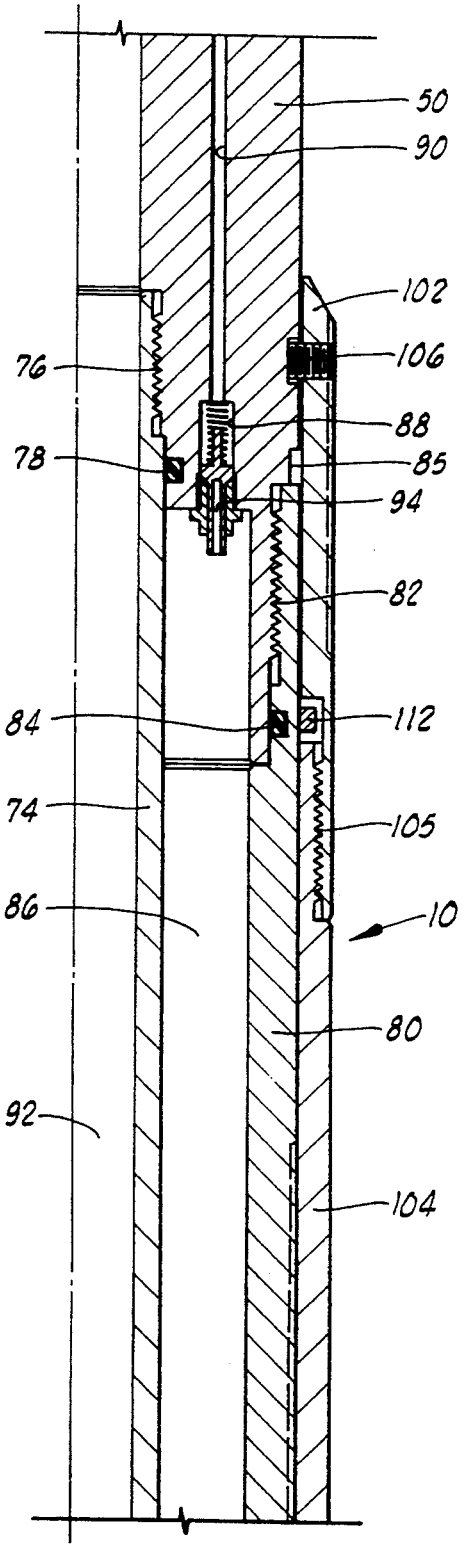

Referring now to FIG. 1C, the lower end of upper housing 50 is attached to a piston mandrel 74 at threaded connection 76. A sealing means, such as O-ring 78, provides sealing engagement between upper housing 50 and piston mandrel 74.

The lower end of upper housing 50 is also connected to a seal adapter 80 at threaded connection 82. A sealing means, such as an O-ring 84, provides sealing engagement between upper housing 50 and seal adapter 80.

A groove 85 is defined by upper housing 50 and seal adapter 80 adjacent to the upper end of the seal adapter.

Seal adapter 80 is spaced radially outwardly from piston mandrel 74 such that an annulus 86 is defined therebetween. A longitudinally disposed opening 88 is defined in upper housing 50 and is in communication with annulus 86. A longitudinal port 90 provides communication between opening 88 and a central opening 92 through tool 10. See FIGS. 1B and 1C.

A relief valve assembly 94 is disposed in opening 88 and initially prevents communication between port 90 and annulus 86. Relief valve assembly 94 is of a kind generally known in the art.

Figure 1D:
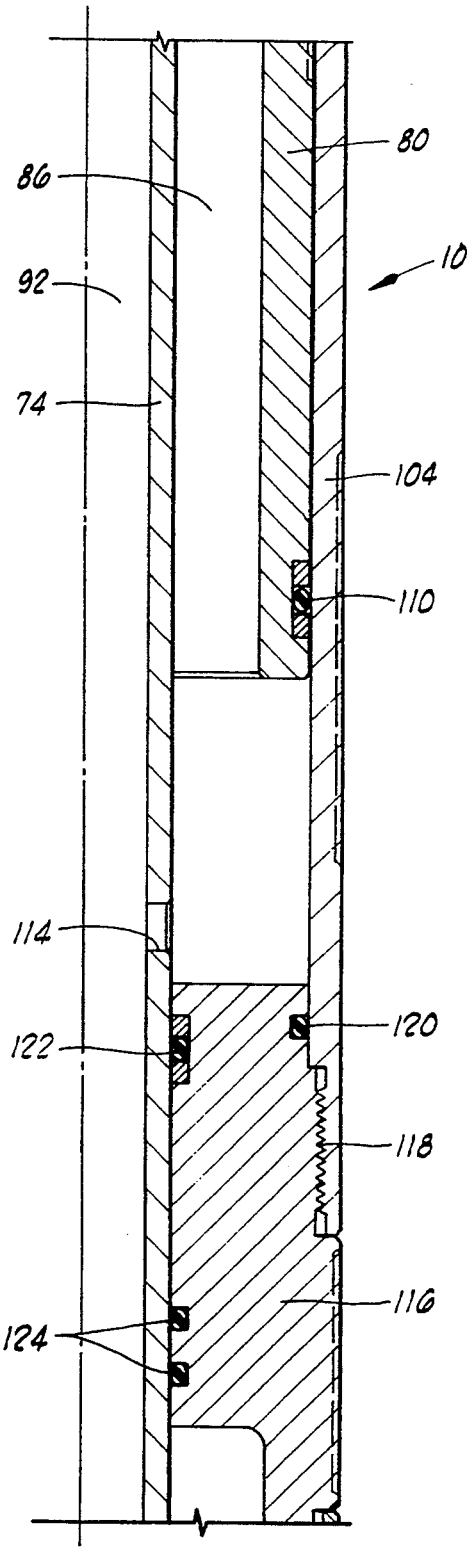

An upper cylinder retainer 102 is initially attached to upper housing 50 by a shearing means, such as a plurality of shear pins 106. Upper cylinder retainer 102 is attached to an upper cylinder 104 at threaded connection 105. A sealing means, such as seal 110, provides sealing engagement between upper cylinder 104 and an enlarged lower end of seal adapter 80, as shown in FIG. 1D.

Still referring to FIG. 1C, an inwardly biased locking dog 112 is disposed between upper cylinder retainer 102 and upper cylinder 104. Locking dog 112 is adapted for engagement with groove 85, as will be further described herein.

Referring again to FIG. 1D, a setting port 114 is defined through piston mandrel 74, providing communication between central opening 92 through tool 10 and annulus 86.

The lower end of upper cylinder 104 is connected to a setting piston 116 at threaded connection 118. A sealing means, such as O-ring 120, provides sealing engagement between upper cylinder 104 and setting piston 116.

Another sealing means, such as seal 122 and O-rings 124, provides sliding, sealing engagement between setting piston and piston mandrel 74.

Figure 1E:
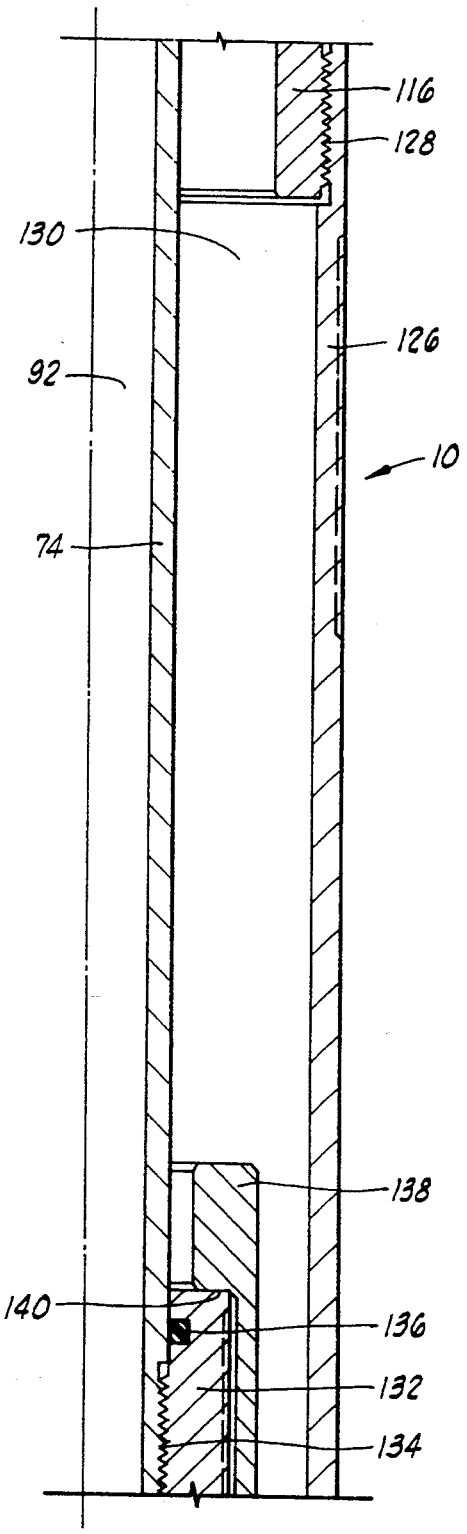

Referring now to FIG. 1E, the lower end of setting piston is connected to a setting sleeve 126 at threaded connection 128. Setting sleeve 126 is spaced radially outwardly from piston mandrel 74 so that an annulus 130 is defined therebetween below setting piston 116.

The lower end of piston mandrel 74 is attached to a mandrel adapter 132 at threaded connection 134. A sealing means, such as O-ring 136, provides sealing engagement between piston mandrel 74 and mandrel adapter 132.

An adapter sleeve 138 is disposed around mandrel adapter and has a downwardly facing shoulder 140 therein adjacent to the upper end of mandrel adapter 132.

Figure 1F:
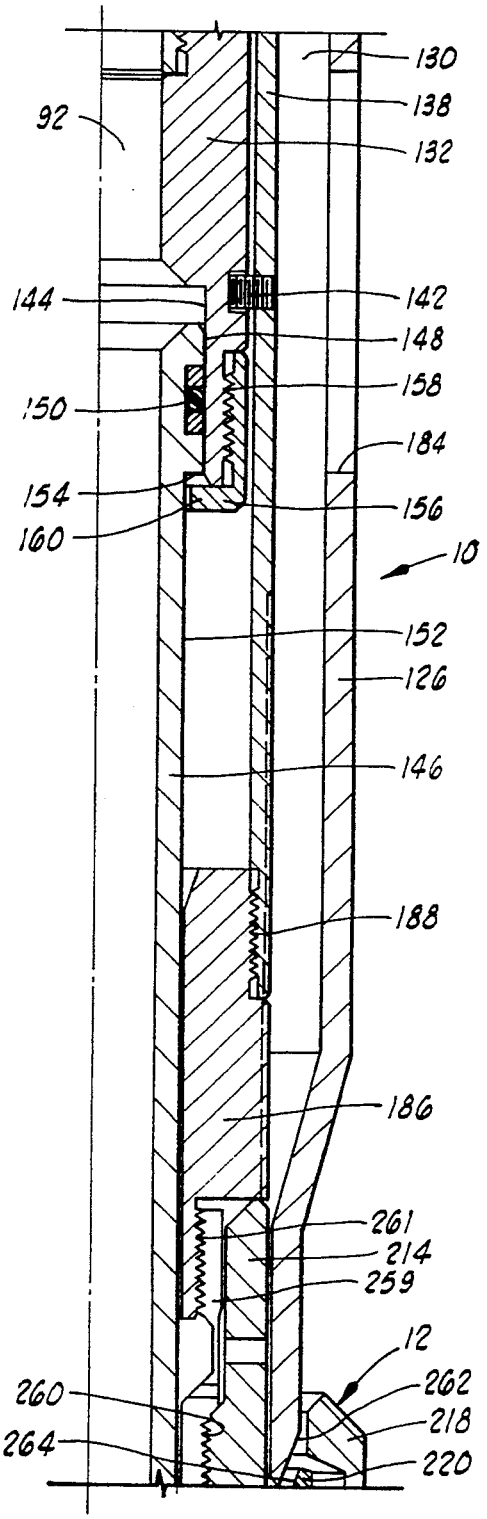

Referring now to FIG. 1F, mandrel adapter 132 is attached to adapter sleeve 138 by a shear means, such as shear pin 142.

The lower end of mandrel adapter 132 defines a bore 144 therein. An actuating mandrel 146 has a first outside diameter 148 which is disposed in bore 144. A sealing means, such as seal 150, provides sliding, sealing engagement between actuating mandrel 146 and bore 144 in mandrel adapter 132. Actuating mandrel 146 has a smaller, second outside diameter 152 such that a shoulder 154 is defined between the second outside diameter and first outside diameter 148.

A mandrel retainer 156 is attached to mandrel adapter 132 at threaded connection 158. Mandrel retainer 156 has a radially inwardly directed flange portion 160 which prevents actuating mandrel 146 from being disengaged from mandrel adapter 132.

A sleeve port 184 is defined through setting sleeve 126, providing communication between annulus 130 and the well annulus.

The lower end of adapter sleeve 138 is attached to a packer adapter 186 at threaded connection 188.

Figure 1G:
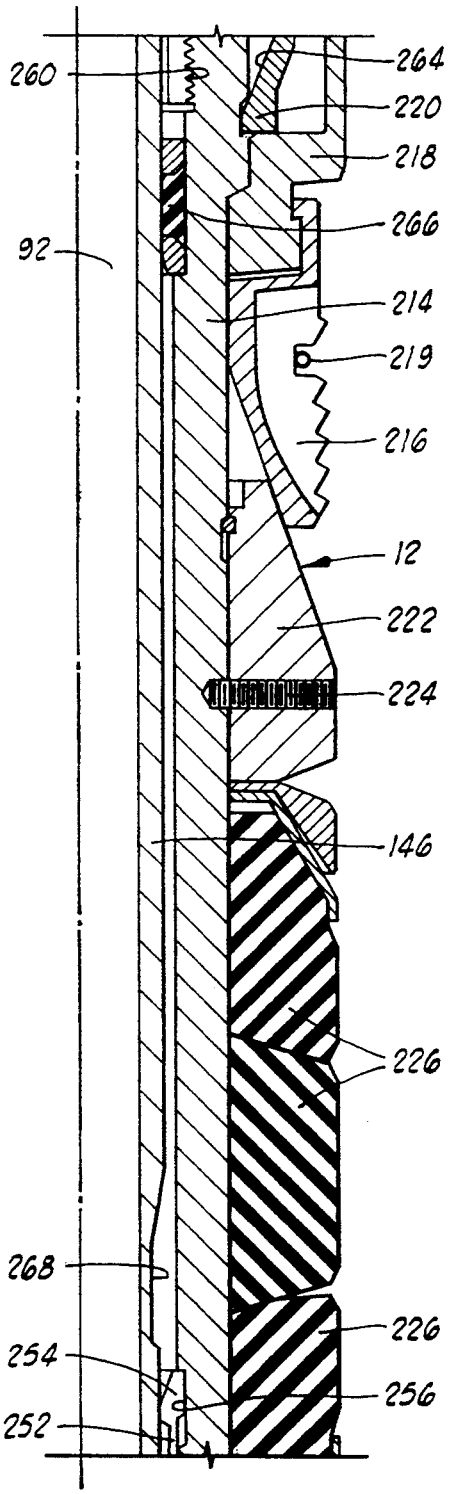

Referring now to FIGS. 1F and 1G, the engagement of first embodiment hydraulic setting tool 10 with a packer 12 is illustrated. In the illustrated embodiment, packer 12 is a Halliburton Services EZ Drill SV® squeeze packer. Packer 12 is of a kind known in the art, but will be described briefly herein so that operation of hydraulic setting tool 10 is fully understood.

Packer 12 has an inner mandrel 214 with a plurality of upper slips 216 disposed therearound. Upper slips 216 are held in place by upper slip support 218 and a retainer ring 219. Upper slip support 218 is initially locked onto inner mandrel 214 by a lock ring 220.

Figure 1H:
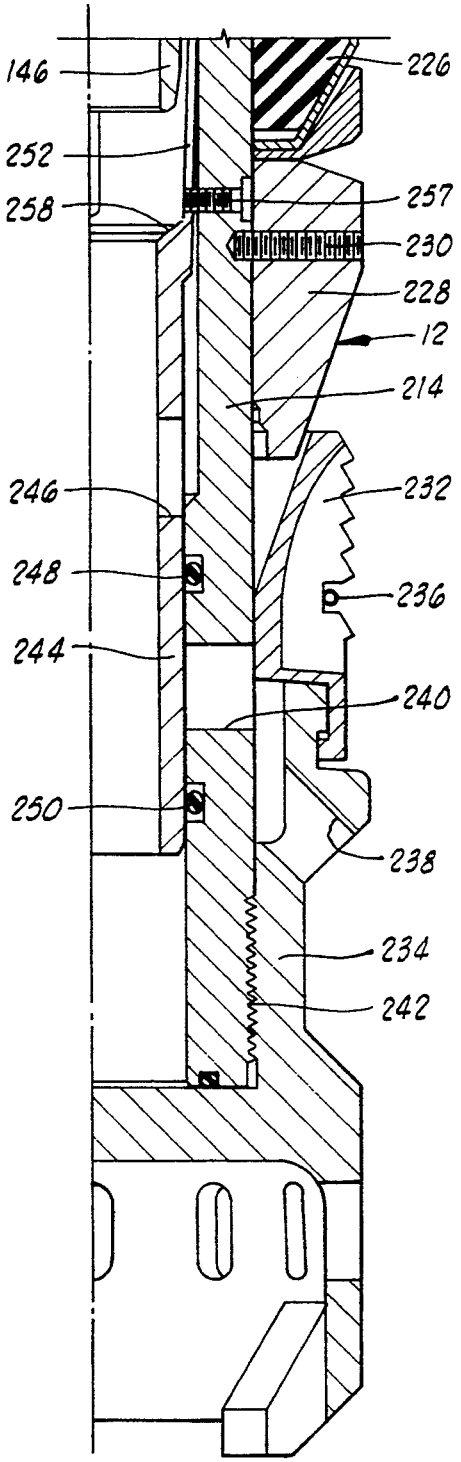

Upper slips 216 are engaged with an upper slip wedge 222 which is held onto inner mandrel 214 by a shear pin 224. A plurality of elastomeric packer elements 226 are disposed below upper slip wedge 222, and a lower slip wedge 228 is disposed below packer elements 226 as seen in FIG. 1H. Lower slip wedge 228 is held to inner mandrel 214 by a shear pin 230.

A plurality of lower slips 232 are disposed around inner mandrel 214 adjacent to lower slip wedge 228 and supported by lower slip support 234. A retainer ring 236 holds lower slips 232 in place, initially. Lower support 234 defines a port 238 therethrough which is in communication with a mandrel port 240 in inner mandrel 214. Inner mandrel 214 is attached to lower slip support 234 at threaded connection 242.

A sliding valve 244 is slidably disposed in mandrel 214. In the initial, closed shown in FIG. 1H, a valve port 246 defined through valve 244 is spaced longitudinally upwardly from mandrel port 240. A sealing means, such as first seal 248 and second seal 250, provide sliding, sealing engagement between valve 244 and inner mandrel 214. First and second seals 248 and 250 are disposed on opposite sides of mandrel port 240.

As seen in FIGS. 1G and 1H, extending upwardly from valve 244, and preferably integral therewith, are a plurality of collet fingers 252 which are biased radially outwardly. In the illustrated closed position, a head portion 254 of each collet finger 252 is engaged with a groove 256 defined in inner mandrel 214. A guide pin 257 extends between adjacent collet fingers 252 to prevent rotation of valve 244 within packer mandrel 214 and to insure proper orientation therebetween.

Below collet fingers 252, valve 244 has an inner shoulder 258 defined therein.

Referring again to FIG. 1F, the lower end of packer adapter 186 in setting tool 10 is attached to a shearable connector or tension sleeve 259 in packer 12 at threaded connection 261. The lower end of shearable connector 259 is attached to inner mandrel 214 of packer 12 at threaded connection 260.

The lower end of setting sleeve 126 extends into upper slip support 218 and has a chamfered surface 262 thereon which generally faces a corresponding chamfered surface 264 in lock ring 220.

Actuating mandrel 146 of setting tool 10 extends downwardly through inner mandrel 214 of packer 12. A seal 266 in packer 12 seals between actuating mandrel 146 of setting tool 10 and inner mandrel 214 of the packer.

Referring again to FIG. 1G, the lower end of actuating mandrel 146 extends into collet fingers 252. A groove 268 is defined on actuating mandrel 146, and groove 268 is initially disposed above head portions 254 of collet fingers 252.

Operation of the First Embodiment

Hydraulic setting tool 10 with packer 12 attached thereto at threaded connection 261 is run into the well bore and located in the desired position. As the tool is run in, ports 66 in valve enclosure 56 and ports 64 in valve mandrel 20 act as bypass ports, allowing fluid into hydraulic setting tool 10 and up through the tool string.

After tool 10 and packer 12 are positioned, it is necessary to close bypass ports 64. Well annulus pressure is increased which applies an increasing downward force on valve 34 due to the differential pressure area between first bore 36 and second bore 38 in the valve, as previously mentioned. When this downward force exceeds the strength of shear pins 44, shear pins 44 are sheared so that valve 34 and shear pin adapter 40 slide downwardly along valve mandrel 20. Valve 34 moves downwardly past ports 64 in valve mandrel 20, and the lower end of valve 34 is sealingly engaged with seal 72, thus closing ports 64 and sealingly separating central opening 92 in tool 10 from the well annulus. Thus, a hydraulic valve means is provided for closing bypass ports 64. When locking dog 48 becomes aligned with groove 32 the locking dog will move radially inwardly to engage the groove so that further longitudinal movement of valve 34 is prevented and locking the valve in the closed position. Annulus pressure is then relieved.

Tubing pressure is then applied so that the pressure in central opening 92 of hydraulic setting tool 10 is increased. This pressure is transmitted to annulus 86 through setting port 114. It will be seen that the pressure in annulus 130 is maintained at well annulus pressure through sleeve port 184. Thus, as pressure in annulus 86 is increased above the pressure in annulus 130, a downward force is applied to setting piston 116. When a sufficient pressure has been applied, shear pins 106 which initially hold upper cylinder retainer 102 to upper housing 50 are sheared so that setting piston 116 can move downwardly.

It will thus be seen that the entire outer portion of setting tool 10 moves downwardly with respect to the inner portion thereof. That is, setting piston 116 and setting sleeve 126 are moved downwardly with respect to piston mandrel 74, mandrel adapter 132 and actuating mandrel 146.

Referring now to FIGS. 1F and 1G, as setting sleeve 126 is moved downwardly with respect to inner mandrel 214 of packer 12, chamfered surface 262 on the setting sleeve engages chamfered surface 264 in lock ring 220 which forces the lock ring radially outwardly until it breaks. At this point, relative movement of setting sleeve 126 causes upper slips 216 to move downwardly until shear pin 224 on upper slip wedge 222 is sheared. Further relative movement compresses packer elements 226 and shears shear pin 230 holding lower slip wedge 228 to inner mandrel 214. Eventually, packer elements 226 are squeezed into sealing engagement with the well bore. Upper slips 216 are forced outwardly by engagement with upper slip wedge 222 to grippingly engage the well bore, and similarly, lower slips 232 are forced radially outwardly by engagement with lower slip wedge 228 to also grippingly engage the well bore.

Eventually, enough downward force is applied to the outside of packer 12 so that sufficient tension is applied to shearable connector or tension sleeve 259 to cause it to be sheared, thus releasing the packer from the setting tool. At this point, the packer is set.

Thus, a hydraulic setting means is provided by tool 10 for setting packer 12 in the well bore without manipulation of the tool string.

After the setting process, tubing pressure may be relieved. Weight is set down on the tool string. This results in a downward force acting on the inner portions of setting tool 10. It will thus be seen that piston mandrel 74, seal adapter 80 and upper housing 50 will be moved downwardly with respect to setting piston 116, setting sleeve 126, upper cylinder 104 and upper cylinder retainer 102. Eventually, locking dog 112 will become aligned with groove 85 so that locking dog 112 will move radially inwardly to engage groove 85. Thus, there is a mechanical locking means for preventing further movement, and the relatively moving parts are locked together.

As piston mandrel 74 is moved inside setting piston 116, seal 122 is moved above setting port 114, thus sealingly closing the setting port. Once setting port 114 is closed, fluid trapped in annulus 86 is relieved through relief valve assembly 94.

Setting down weight on the tool string also results in enough downward movement of actuating mandrel 146 to engage shoulder 258 in valve 244 and to force valve 244 downwardly until valve ports 246 are substantially aligned with mandrel port 240, thus opening the valve. As this occurs, groove 268 in actuating mandrel 146 is generally aligned with head portions 254 of collet fingers 252. As valve 244 moves downwardly, head portions 254 are moved downwardly past groove 256 in inner mandrel 214 such that they are forced radially inwardly into engagement with groove 268 on the actuating mandrel.

The downward movement of piston mandrel 74 and actuating mandrel 146 is allowed by the shearing of shear pin 142 which initially holds mandrel adapter 132 to adapter sleeve 138.

To reclose valve 244 in packer 12, weight is picked up on the tool string, resulting in an upward force being applied to piston mandrel 74 and actuating mandrel 146. Because of the engagement of head portions 254 of collet fingers 252 on valve 244 with groove 268 on actuating mandrel 146, valve 244 may thus be moved to its closed position shown in FIG. 1H.

Thus, an actuating means is provided for actuating the valve in the packer between open and closed positions thereof.

It will thus be seen that hydraulic setting tool 10 can be used to set packer 12 by pressure actuation only and without any reciprocation or rotation of the tool string. Further, valve 244 in packer 12 may be opened and closed as many times as desired.

Second Embodiment

Referring now to FIGS. 2A–2J, a second embodiment of the hydraulic setting tool of the present invention is shown and generally designated by the numeral 300. Hydraulic setting tool 300 is, like first embodiment 10, used to set a packer 12, such as the Halliburton E-Z Drill SV® squeeze packer. Second embodiment hydraulic setting tool 300 uses many of the same components as first embodiment 10, and in most cases, the same reference numerals will be used herein.

Figure 2A:
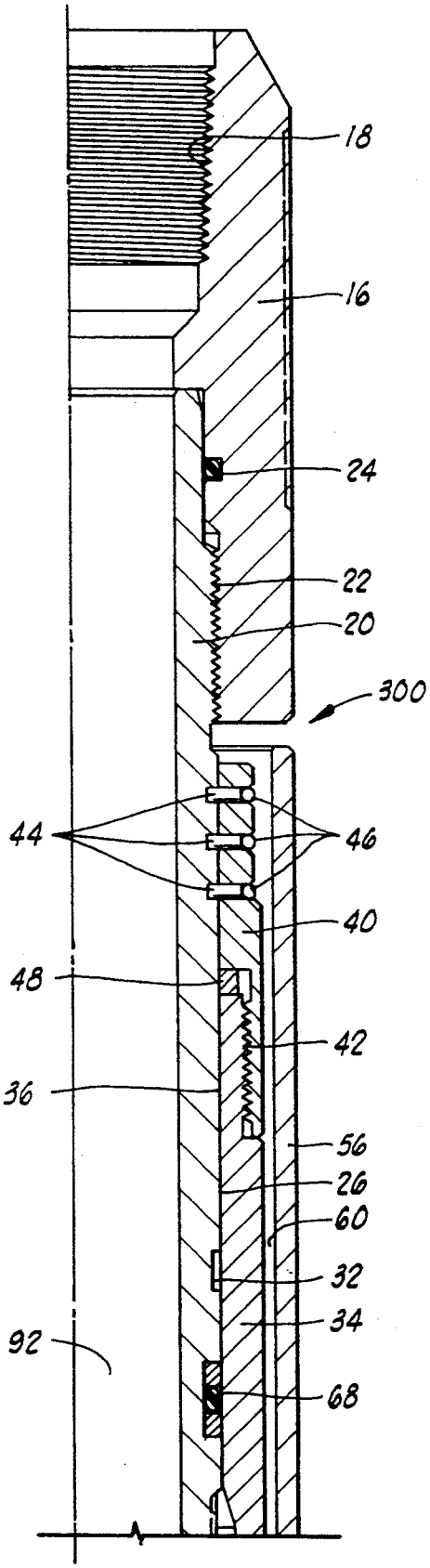
FIGS. 2A–2J illustrate a second embodiment of the setting tool using two setting pistons.

Referring now to FIG. 2A, at the upper end of second embodiment setting tool 300 is an upper adapter 16 having an internally threaded surface 18 adapted for connection to a tool string.

Upper adapter 16 is connected to a valve mandrel 20 at threaded connection 22. A sealing means, such as O-ring 24, provides sealing engagement between upper adapter 16 and valve mandrel 20.

Figure 2B:
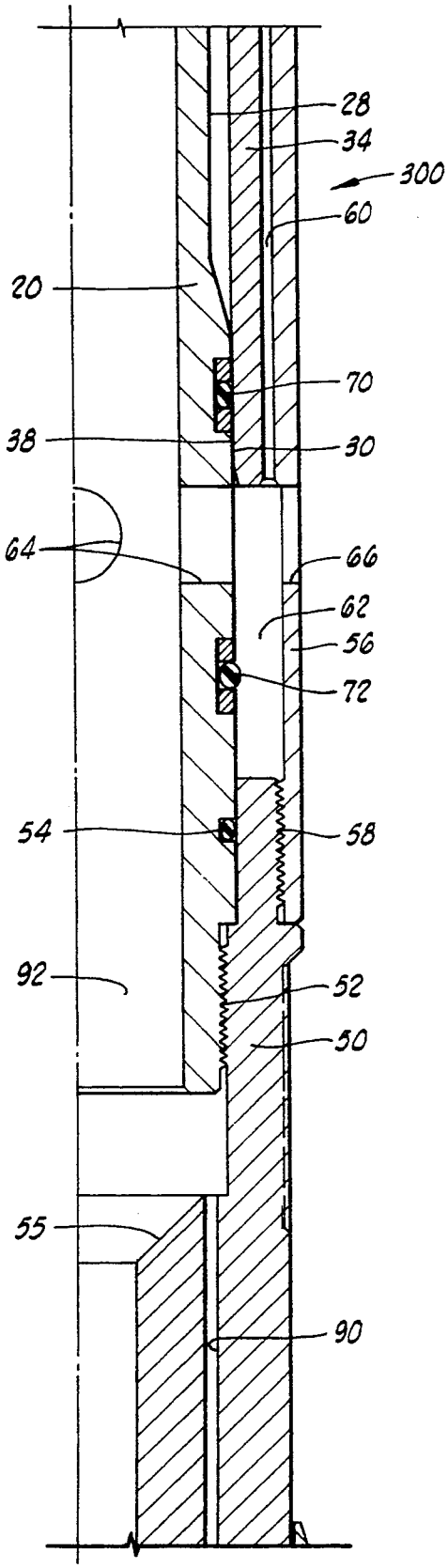

Valve mandrel 20 has a first outside diameter 26 with a recessed second outside diameter 28 therebelow, as seen in FIGS. 2A and 2B. Valve mandrel 20 has a larger third outside diameter 30. A groove 32 is defined in first outside diameter 26.

A bypass valve 34 is slidably disposed on valve mandrel 20 and has a first bore 36 slidably engaged with first outside diameter 26 of the valve mandrel. Valve mandrel 34 also has a second bore 38 in sliding engagement with third outside diameter 30 of valve mandrel 20, as seen in FIG. 2B.

The upper end of valve 34 is connected to a shear pin adapter 40 at threaded connection 42. A plurality of shear pins 44 extend through shear pin adapter 40 into valve mandrel 20, and it will be seen by those skilled in the art that valve 34 is thus shearably connected to the valve mandrel in the initial position shown in FIG. 2A. Shear pin retainer rings 46 are disposed outwardly of shear pins 44 to hold the shear pins in position. An inwardly biased locking dog or retainer ring 48 is disposed between valve 34 and shear pin adapter 40. As will be further described herein, locking dog 48 is adapted for engagement with groove 32 in valve mandrel 20 when valve 34 is closed.

Referring again to FIG. 2B, the lower end of valve mandrel 20 is attached to an upper housing 50 at threaded connection 52. A sealing means, such as O-ring 54, provides sealing engagement between upper housing 50 and valve mandrel 20. Upper housing 50 has a shoulder 55 therein.

Extending upwardly from upper housing 50 is a valve enclosure 56 which is connected to the upper housing at threaded connection 58. Valve enclosure 56 is spaced outwardly from valve 34 such that an annular volume 60 is defined therebetween.

A larger annular volume 62 is defined between valve enclosure 56 and the lower end of valve mandrel 20.

A plurality of mandrel bypass ports 64 are defined through the lower end of valve mandrel 20 and are in communication with annular volume 62. A corresponding plurality of enclosure bypass ports 66 are defined through valve enclosure 56 and are also in communication with annular volume 62. It will thus be seen by those skilled in the art that a well annulus defined between tool 300 and the well bore is in communication with mandrel bypass port 64 when the tool is in the initial position shown in FIGS. 2A–2J.

A sealing means, such as seal 68, provides sealing engagement between valve mandrel 20 and first bore 36 in valve 34, as shown in FIG. 2A. Another sealing means, such as seal 70, provides sealing engagement between valve mandrel 20 and second bore 38 in valve 34, as seen in FIG. 2B. Seal 70 is above mandrel bypass ports 64. Because of the sealing action of seals 68 and 70, and because of the size difference between first bore 36 and second bore 38 of valve 34, it will be seen that a differential area is defined between the first and second bores. Well annulus pressure applied to valve 34 thus imparts a net downward force across this differential area on valve 34. Initially, this downward force is overcome by shear pins 44 so that valve 34 does not move. A sufficient increase in well annulus pressure will cause valve 34 to be moved downwardly, as further described herein.

Valve mandrel 20 also carries a third sealing means, such as seal 72, which is disposed below mandrel bypass ports 64. In the initial position shown in the drawings, seal 72 is not active. However, after valve 34 is moved, seal 72 is adapted for sealing engagement with second bore 38 in the valve, as further described herein.

Figure 2C:
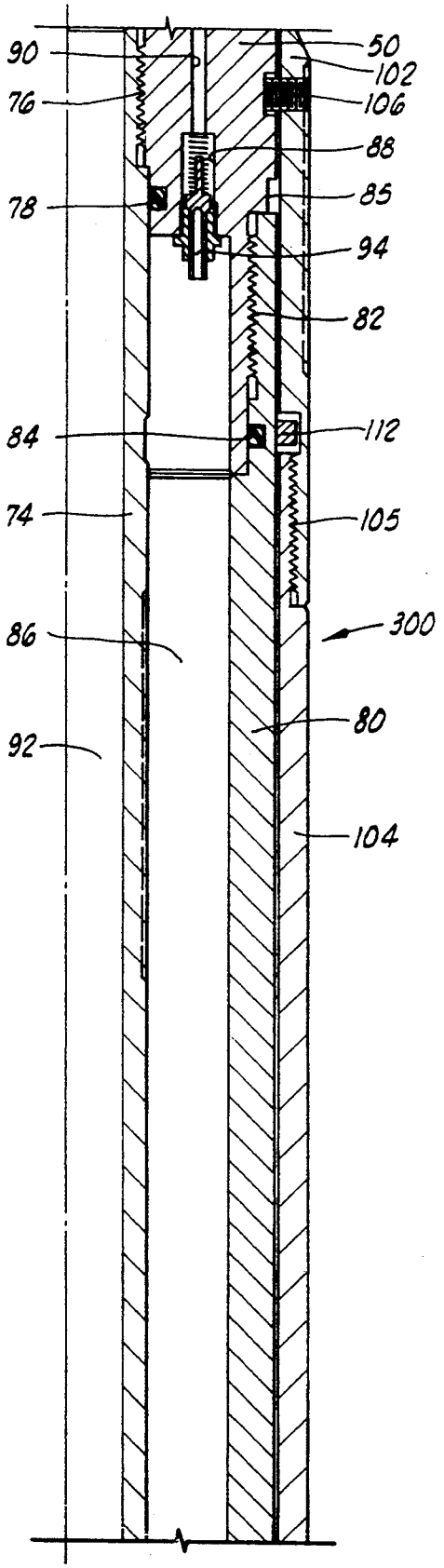

Referring now to FIG. 2C, the lower end of upper housing 50 is attached to a piston mandrel 74 at threaded connection 76. A sealing means, such as O-ring 78, provides sealing engagement between upper housing 50 and piston mandrel 74.

The lower end of upper housing 50 is also connected to a seal adapter 80 at threaded connection 82. A sealing means, such as an O-ring 84, provides sealing engagement between upper housing 50 and seal adapter 80.

A groove 85 is defined by upper housing 50 and seal adapter 80 adjacent to the upper end of the seal adapter.

Seal adapter 80 is spaced radially outwardly from piston 74 such that an annulus 86 is defined therebetween. A longitudinally disposed opening 88 is defined in upper housing 50 and is in communication with annulus 86. A longitudinal port 90 provides communication between opening 88 and a central opening 92 through tool 10. See FIGS. 2B and 2C.

A first or upper relief valve assembly 94 is disposed in opening 88 and initially prevents communication between port 90 and annulus 86. Relief valve 94 is of a kind generally known in the art.

Figure 2D:
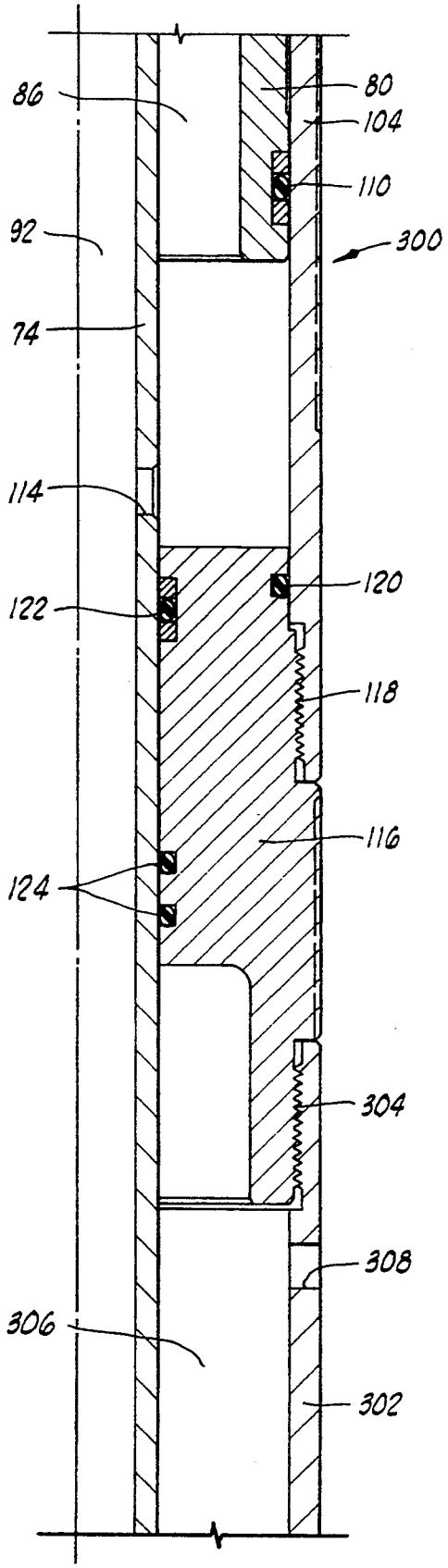

An upper cylinder retainer 102 is initially attached to upper housing 50 by a shearing means, such as a plurality of shear pins 106. Upper cylinder retainer 102 is attached to an upper cylinder 104 at threaded connection 105. A sealing means, such as seal 110, provides sealing engagement between upper cylinder 104 and an enlarged lower end of seal adapter 80, as shown in FIG. 2D.

Still referring to FIG. 2C, an inwardly biased locking dog 112 is disposed between upper cylinder retainer 102 and upper cylinder 104. Locking dog 112 is adapted for engagement with groove 85, as will be further described herein.

Referring again to FIG. 2D, a setting port 114 is defined through piston mandrel 74, providing communication between central opening 92 through tool 300 and annulus 86.

The lower end of upper cylinder 104 is connected to a setting piston 116 at threaded connection 118. A sealing means, such as O-ring 120, provides sealing engagement between upper cylinder 104 and setting piston 116.

Another sealing means, such as seal 122 and O-rings 124, provide sliding, sealing engagement between setting piston 116 and piston mandrel 74.

The lower end of setting piston 116 is connected to a lower housing 302 at threaded connection 304. Lower housing 302 is spaced radially outwardly from piston mandrel 74 such that an annulus 306 is defined therebetween. A housing port 308 is defined through lower housing 302, thereby providing communication between annulus 306 and the well annulus.

Figure 2E:
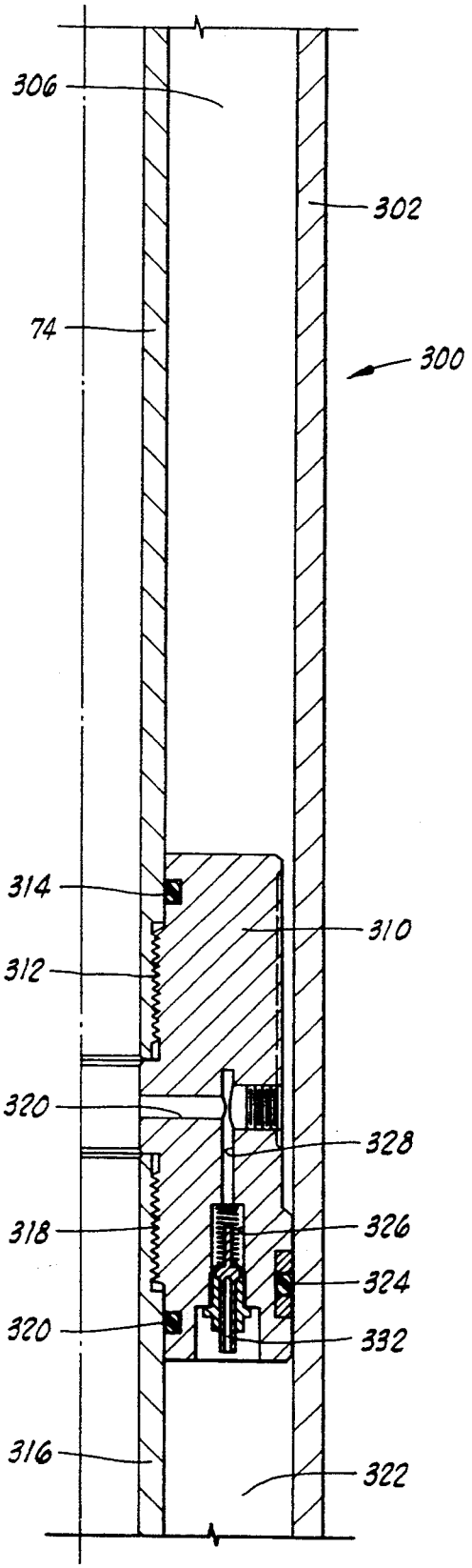

Referring now to FIG. 2E, the lower end of piston mandrel 74 is connected to an intermediate piston 310 at threaded connection 312. A sealing means, such as O-ring 314, provides sealing engagement between intermediate piston 310 and piston mandrel 74.

The lower end of intermediate piston 310 is connected to a lower mandrel 316 at threaded connection 318. A sealing means, such as O-ring 320, provides sealing engagement between intermediate piston 310 and lower mandrel 316.

Below intermediate piston 310, another annulus 322 is defined between lower housing 302 and lower mandrel 316.

A sealing means, such as seal 324, provides sliding, sealing engagement between intermediate piston 310 and lower housing 302. It will be seen that seal 324 separates annulus 306 and annulus 322.

A longitudinal opening 326 is defined in intermediate piston 310 and is in communication with annulus 322. A longitudinal port 328 and a transverse port 330 provide communication between opening 326 and central opening 92 through tool 300.

A second, lower relief valve assembly 332 is positioned in opening 326 and closes opening 326 when in the initial position shown in FIG. 2E. Relief valve assembly 332 is of a kind generally known in the art.

Figure 2F:
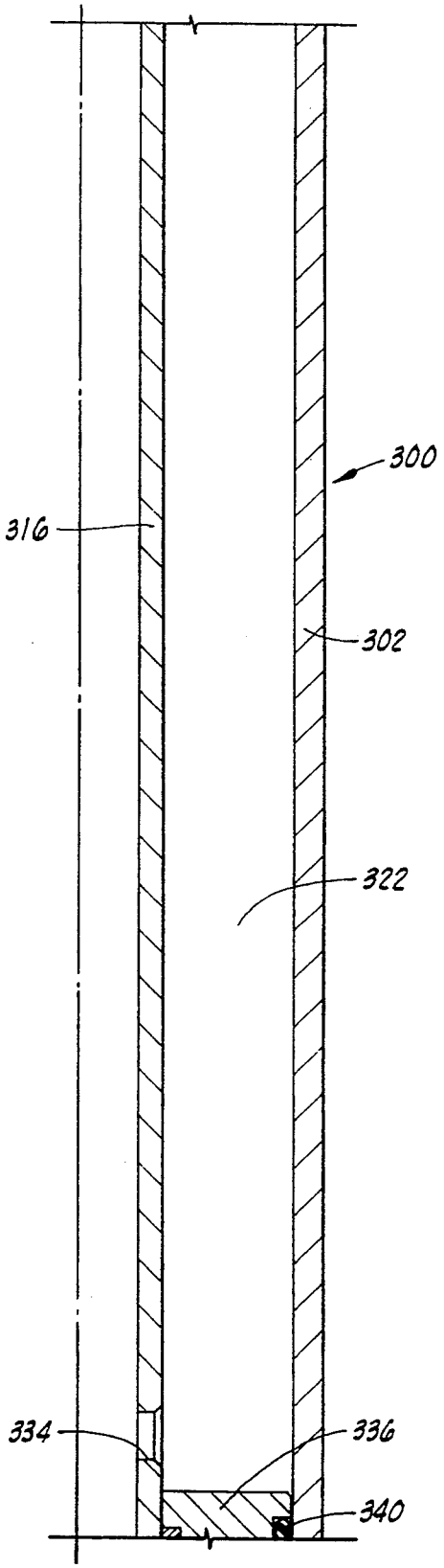

Referring now to FIG. 2F, a lower setting port 334 is defined through lower mandrel 316 and provides communication between central opening 92 and annulus 322.

Figure 2G:
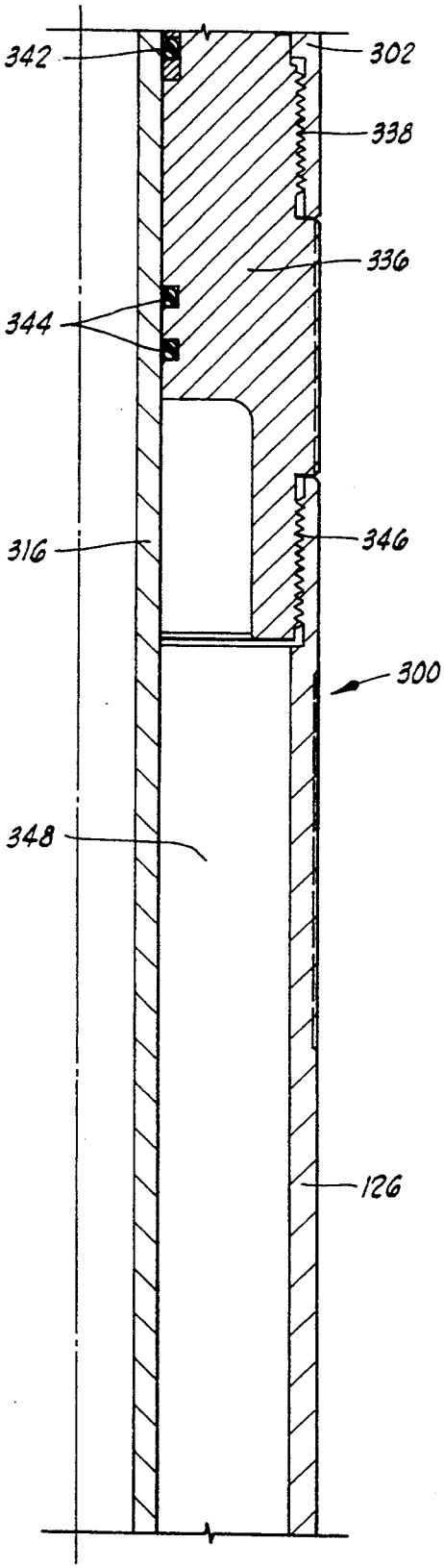

Referring now to FIG. 2G, the lower end of lower housing 302 is connected to a lower setting piston 336 at threaded connection 338. As best seen in FIG. 2F, a sealing means, such as O-ring 340, provides sealing engagement between lower housing 302 and lower setting piston 336.

Referring again to FIG. 2G, another sealing means, such as seal 342 and O-rings 344, provides sliding, sealing engagement between lower setting piston 336 and lower mandrel 316.

The lower end of lower setting piston 336 is connected to a setting sleeve 126 at threaded connection 346. Setting sleeve 126 is spaced radially outwardly from lower mandrel 316 so that an annulus 348 is defined therebetween below lower setting piston 336.

The lower end of lower mandrel 316 is attached to a mandrel adapter 132 at threaded connection 350. A sealing means, such as O-ring 352, provides sealing engagement between lower mandrel 316 and mandrel adapter 132.

An adapter sleeve 138 is disposed around mandrel adapter 132 and has a downwardly facing shoulder 140 therein adjacent to the upper end of mandrel adapter 132.

Figure 2H:
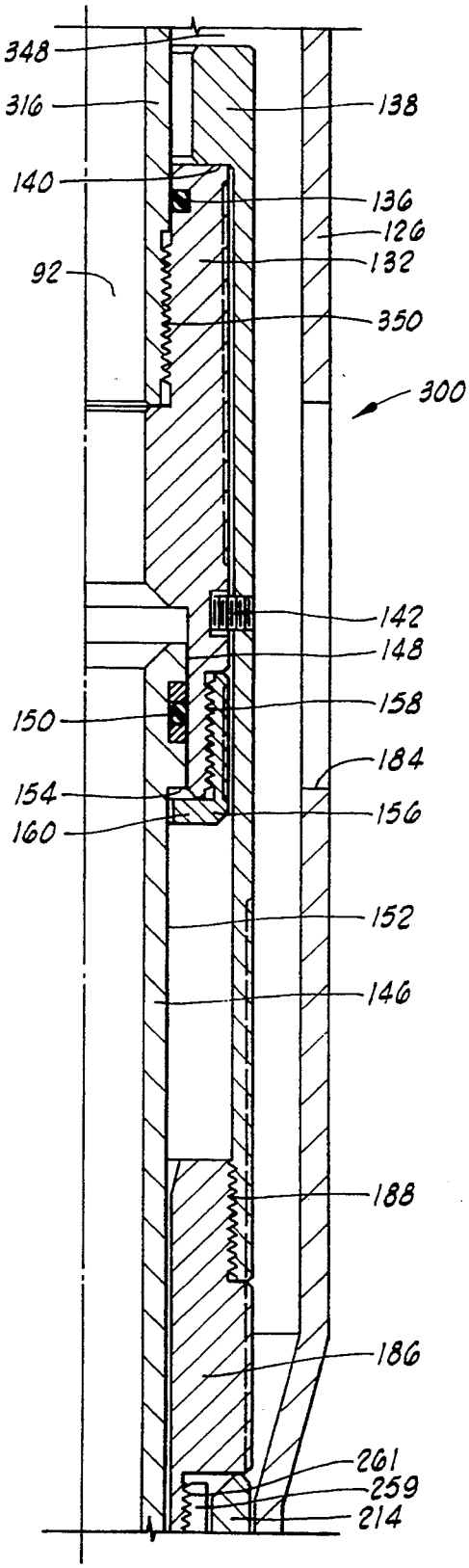

Still referring to FIG. 2H, mandrel adapter 132 is attached to adapter sleeve 138 by a shear means, such as shear pin 142.

The lower end of mandrel adapter 132 defines a bore 144 therein. An actuating mandrel 146 has a first outside diameter 148 which is disposed in bore 144. A sealing means, such as seal 150, provides sliding, sealing engagement between actuating mandrel 146 and bore 144 in mandrel adapter 132. Actuating mandrel 146 has a smaller, second outside diameter 152 such that a shoulder 154 is defined between the second outside diameter and first outside diameter 148.

A mandrel retainer 156 is attached to mandrel adapter 132 at threaded connection 158. Mandrel retainer 156 has a radially inwardly directed flange portion 160 which prevents actuating mandrel 146 from being disengaged from mandrel adapter 132.

A sleeve port 184 is defined through setting sleeve 126, providing communication between annulus 348 and the well annulus.

The lower end of adapter sleeve 138 is attached to a packer adapter 186 at threaded connection 188.

Figure 2I:
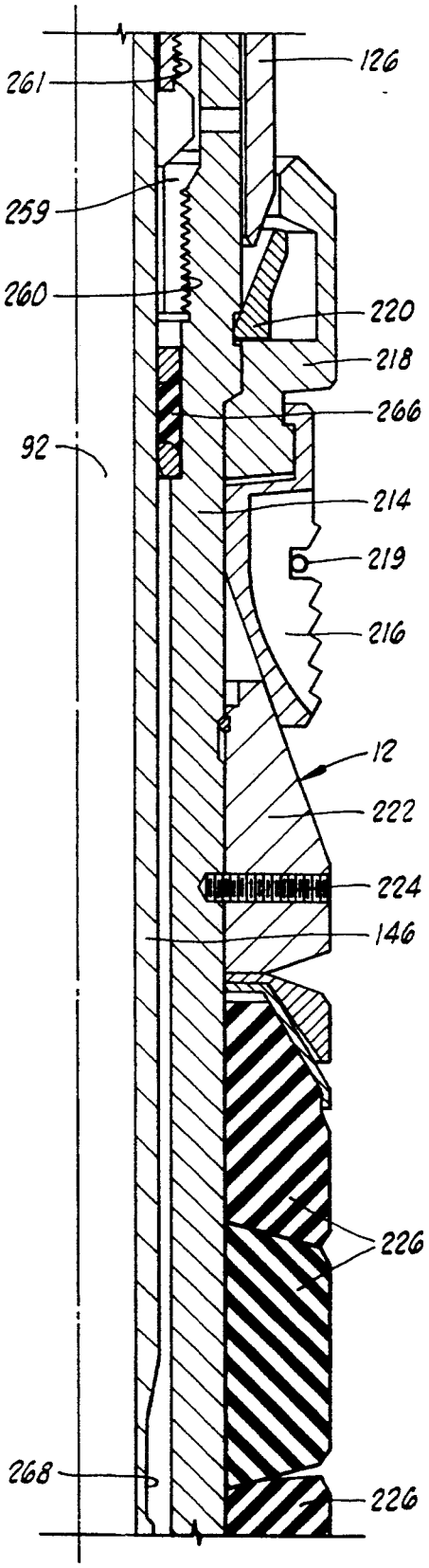
Figure 2J:
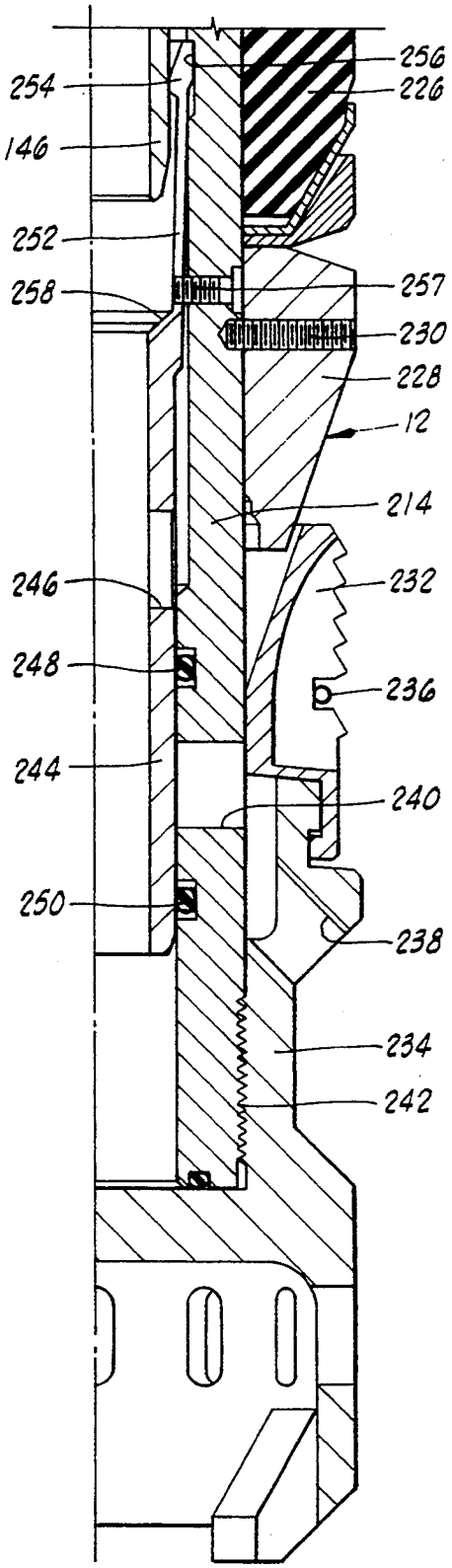

Referring now to FIGS. 2H and 2I, the engagement of second embodiment hydraulic setting tool 300 with a packer 12 as illustrated. The details of packer 12 and the engagement thereof by second embodiment hydraulic setting tool 300 are substantially identical to those for first embodiment hydraulic setting tool 10 and will not be repeated.

Operation of the Second Embodiment

Hydraulic setting tool 300 with packer 12 attached thereto at threaded connection is run into the well bore and located in the desired position in the same manner as with first embodiment 210. As second embodiment hydraulic setting tool 300 is run in, ports 66 in valve enclosure 56 and ports 64 in valve mandrel 20 act as bypass ports, allowing fluid into hydraulic setting tool 300 and up through the tool string.

After tool 10 and packer 12 are positioned, it is necessary to close bypass ports 64. Well annulus pressure is increased which applies an increasing downward force on valve 34 due to the differential pressure area between first bore 36 and second bore 38 in the valve, as previously mentioned. When this downward force exceeds the strength of shear pins 44, shear pins 44 are sheared so that valve 34 and shear pin adapter 40 slide downwardly along valve mandrel 20. Valve 34 moves downwardly past ports 64 in valve mandrel 20, and the lower end of valve 34 is sealingly engaged with seal 72, thus closing ports 64 and sealingly separating central opening 92 in tool 10 from the well annulus. Thus, a hydraulic valve means is provided for closing bypass ports 64. When locking dog 48 becomes aligned with groove 32, the locking dog will move radially inwardly to engage the groove so that further longitudinal movement of valve 34 is prevented and locking the valve in the closed position. Annulus pressure is then relieved.

Tubing pressure is then applied so that pressure in central opening 92 of hydraulic setting tool 300 is increased. This pressure is transmitted to annulus 86 through upper setting port 114 and to annulus 322 through lower setting port 334. It will be seen that the pressure in annulus 306 is maintained at well annulus pressure through housing port 308, and the pressure in annulus 348 is maintained at well annulus pressure through sleeve port 184. Thus, as pressure in annulus 86 is increased above the pressure in annulus 306 and the pressure in annulus 322 is increased above the pressure in annulus 348, a downward force is applied to upper setting piston 116 and lower setting piston 336. When a sufficient pressure has been applied, shear pins 106 which initially hold upper cylinder retainer 102 to upper housing 50 are sheared so that upper setting piston 116 can move downwardly. It will be understood that this also frees lower setting piston 336 to move downwardly.

It will thus be seen that the entire outer portion of setting tool 300 moves downwardly with respect to the inner portion thereof. That is, upper setting piston 116, lower housing 302, lower setting piston 336 and setting sleeve 126 are moved downwardly with respect to piston mandrel 74, intermediate piston 310, lower mandrel 316, mandrel adapter 132 and actuating mandrel 146.

Referring now to FIGS. 2H and 2I, as setting sleeve 126 is moved downwardly with respect to inner mandrel 214 of packer 12, chamfer surface 262 on the setting sleeve engages chamfered surface 264 in lock ring 220 which forces the lock ring radially outwardly until it breaks. At this point, relative movement of setting sleeve 126 causes upper slips 216 to move downwardly until shear pin 224 on upper slip wedge 222 is sheared. Further relative movement compresses packer elements 226 and shears shear pin 230 holding a lower slip wedge 228 to inner mandrel 214. Eventually, packer elements 226 are squeezed into sealing engagement with the well bore. Upper slips 216 are forced outwardly by engagement with upper slip wedge 222 to grippingly engage the well bore, and similarly, lower slips 232 are forced radially outwardly by engagement with lower slip wedge 228 to also grippingly engage the well bore.

Eventually, enough downward force is applied to the outside of packer 12 so that sufficient tension is applied to shearable connector or tension sleeve 259 to cause it to be sheared, thus releasing the packer from the setting tool. At this point, the packer is set.

Thus, a hydraulic setting means is provided by tool 10 for setting packer 12 in the well bore without manipulation of the tool string.

After the setting process, tubing pressure may be relieved. Weight is set down on the tool string. This results in a downward force acting on the inner portions of setting tool 300. It will be seen that lower mandrel 316, intermediate piston 310, piston mandrel 74, seal adapter 80 and upper housing 50 will be moved downwardly with respect to lower setting piston 336, setting sleeve 126, lower housing 302, upper setting piston 116, upper cylinder 104 and upper cylinder retainer 102. Eventually, locking dog 112 will become aligned with groove 85 so that locking dog 112 will move radially inwardly to engage groove 85. Thus, there is a mechanical locking means for preventing further movement, and the relatively moving parts are locked together.

As piston mandrel 74 is moved inside upper setting piston 116, seal 122 is moved above upper setting port 114, thus sealingly closing the upper setting port. Once upper setting port 114 is closed, fluid trapped in annulus 86 is relieved through upper relief valve assembly 94. Similarly, as lower mandrel 316 is moved inside lower setting piston 336, seal 342 is moved above lower setting port 334, thus sealingly closing the lower setting port. Once lower setting port 334 is closed, fluid trapped in annulus 322 is relieved through lower relief valve assembly 332.

Setting down weight on the tool string also results in enough downward movement of actuating mandrel 146 to engage shoulder 258 in valve 244 and to force valve 244 downwardly until valve ports 246 are substantially aligned with mandrel port 240, thus opening the valve. As this occurs, groove 268 in actuating mandrel 146 is generally aligned with head portions 254 of collet fingers 252. As valve 244 moves downwardly, head portions 254 are moved downwardly past groove 256 in inner mandrel 214 such that they are forced radially inwardly into engagement with groove 268 on the actuating mandrel.

The downward movement of piston mandrel 74, intermediate piston 310, lower mandrel 316 and actuating mandrel 146 is allowed by the shearing of shear pin 142 which initially holds mandrel adapter 132 to adapter sleeve 138.

To reclose valve 244 in packer 12, weight is picked up on the tool string, resulting in an upward force being applied to piston mandrel 74, intermediate piston 310, lower mandrel 316 and actuating mandrel 146. Because of the engagement of head portions 254 of collet fingers 252 on valve 244 with groove 268 on actuating mandrel 146, valve 244 may thus be moved to its closed position shown in FIG. 2J.

Thus, an actuating means is provided for actuating the valve in the packer between open and closed positions thereof.

Thus, hydraulic setting tool 300 can be used to set packer 12 by pressure actuation only and without any reciprocation or rotation of the tool string. Further, valve 244 in packer 12 may be opened and closed as many times as desired.

It will be seen, therefore, that the hydraulic setting tool of the present invention is well adapted to carry out the ends and advantages mentioned, as well as those inherent therein. While a presently preferred embodiment of the apparatus has been shown for the purposes of this disclosure, numerous changes in the arrangement and construction of parts may be made by those skilled in the art. All such changes are encompassed with the scope and spirit of the appended claims.

What is claimed is:

1. A hydraulic setting tool for use in setting a packer in a well bore, the packer having a valve therein, said tool comprising:

hydraulic setting means comprising:

an outer portion;

an inner portion wherein an annulus is defined between said inner and outer portions; and setting piston means disposed in said annulus and connected to said outer portion for responding to a pressure differential thereacross thereby causing relative movement between said inner and outer portions without rotation thereof;

mechanical locking means for preventing said relative movement between said inner and outer portions of said hydraulic setting means after setting of the packer; and actuating means for selectively actuating the valve in the packer between open and closed positions of the valve after actuation of the locking means in response to relative movement between inner and outer portions of said actuating means.

2. The tool of claim 1 further comprising pressure relief means for relieving fluid pressure in said hydraulic setting means when said locking means is actuated.

3. The tool of claim 1 further comprising shearing means for shearably holding said outer portion of said hydraulic setting means in an initial position with respect to said inner portion of said hydraulic setting means.

4. The tool of claim 1 wherein said locking means comprises a locking dog engageable with a groove in one of said inner and outer portions.

5. The tool of claim 1 wherein said setting piston means comprises a plurality of setting pistons connected to said outer portion of said hydraulic setting means and movable with respect to said inner portion of said hydraulic setting means.

6. The tool of claim 1 wherein said actuating means comprises and actuating mandrel adapted for engaging collet fingers on the valve in the packer.

7. The tool of claim 1 wherein said actuating means is shearably connected to said setting means.

8. The tool of claim 1 further comprising bypass means for bypassing fluid through the tool as the tool and packer are run into a well bore.

9. A hydraulic setting tool for use in setting a packer in a well bore, the packer having a valve therein, said tool comprising:

hydraulic setting means for setting the packer in said well bore in response to relative movement between inner and outer portions of said hydraulic setting means;

mechanical locking means for preventing said relative movement after setting of the packer;

actuating means for actuating the valve in the packer after actuation of the locking means;

bypass means for bypassing fluid through the tool as the tool and packer are run into a well bore, said bypass means comprising a valve enclosure attached to said hydraulic setting means and defining an enclosure bypass port therethrough;

a valve mandrel disposed in said valve enclosure such that an annular volume is defined therebetween, said valve mandrel defining a mandrel bypass port therethrough; and a valve disposed in said annular volume and having an open position wherein said enclosure bypass port and said mandrel bypass port are in communication and a closed position wherein communication between said enclosure bypass port and said mandrel bypass port is prevented.

10. The tool of claim 9 wherein said valve is movable from said open position to said closed position in response to well annulus pressure.

11. A hydraulic setting tool for use with a packer having a valve therein, said tool comprising:

mandrel means for connecting to a tool string;

housing means disposed around said mandrel means for moving longitudinally relative thereto;

a piston connected to said housing means and adapted for sliding, sealing engagement with said mandrel means, said piston being responsive to a pressure in the tool string such that said piston and said housing means are moved relative to said mandrel means without manipulation of the tool string; and locking means for locking said housing means and mandrel means against further relative movement after setting of said packer, said locking means being actuated in response to longitudinal movement of the tool string.

12. The tool of claim 11 further comprising a relief valve in communication with said piston.

13. The tool of claim 11 further comprising shearing means for shearably holding said housing means in an initial position with respect to said mandrel means.

14. The tool of claim 11 further comprising shearing means for shearably holding said mandrel means in an initial position with respect to an inner mandrel in the packer.

15. The tool of claim 11 wherein said mandrel means comprises an actuating mandrel adapted for engagement with collet fingers on the valve in the packer.

16. The tool of claim 11 further comprising bypass means for bypassing fluid through the tool as the tool and packer are run into a well bore.

17. The tool of claim 16 wherein said bypass means comprises:

a port defined through said mandrel means; and a bypass valve slidably disposed on said mandrel means for closing said port.

18. The tool of claim 17 wherein said bypass valve defines a differential area thereon, such that as pressure is applied to said differential area, a force is applied to said bypass valve tending to move it to a closed position.

19. The tool of claim 17 further comprising shearing means for holding said bypass valve in an initial position with respect to said mandrel means.

20. The tool of claim 17 further comprising bypass locking means for locking said bypass valve in a closed position.

21. The tool of claim 11 wherein said piston is an upper piston, and further comprising:

an intermediate piston disposed below said upper piston and connected to said mandrel means and adapted for sliding, sealing engagement with said housing means; and a lower piston below said intermediate piston and connected to said housing means and adapted for sliding, sealing engagement with said mandrel means, said lower piston being responsive to a pressure in the tool string such that said lower piston and said housing means are moved relative to said mandrel means.

22. The tool of claim 21 further comprising:

an upper relief valve in communication with said upper piston; and a lower relief valve in communication with said lower piston.

23. The tool of claim 22 wherein:

said upper relief valve is connected to said mandrel means; and said lower relief valve is connected to said intermediate piston.

24. A method of setting a packer in a well bore comprising the steps of:

attaching a setting tool to the end of a tool string;

connecting said packer to said setting tool and positioning said setting tool and packer at a predetermined location in the well bore;

applying tubing pressure to said setting tool for hydraulically setting said packer without manipulation of said tool string;

after setting of said packer, longitudinally moving said tool string to mechanically lock said setting tool and thereby preventing further hydraulic actuation thereof; and after locking said setting tool, longitudinally moving said tool string to selectively open and close a valve in said packer.

25. The method of claim 24 further comprising the step of:

before the step of hydraulically setting said packer, applying well annulus pressure for closing a bypass valve on said setting tool.

26. A hydraulic setting tool for use in setting a packer in a well bore, the packer having a valve therein, said tool comprising:

hydraulic setting means for setting the packer in said well bore, said hydraulic setting means comprising:

an outer portion;

an inner portion such that an annulus is defined between said inner and outer portions; and setting piston means disposed in said annulus and connected to said outer portion for responding to pressure applied thereto and resulting in movement of said outer portion with respect to said inner portion during a setting operation;

mechanical locking means for preventing said movement of said outer portion with respect to said inner portion after setting of the packer;

actuating means for actuating the valve in the packer after actuation of the locking means; and a relief valve in communication with said annulus for limiting pressure therein.

27. A hydraulic setting tool for use in setting a packer in a well bore, the packer having a valve therein, said tool comprising:

hydraulic setting means for setting the packer in said well bore, said hydraulic setting means comprising:

an outer portion;

an inner portion such that an annulus is defined between said inner and outer portions, said inner portion defining a setting port therethrough; and setting piston means disposed in said annulus and connected to said outer portion for responding to pressure applied thereto and resulting in movement of said outer portion with respect to said inner portion during a setting operation;

mechanical locking means for preventing said movement of said outer portion with respect to said inner portion of said setting means after setting of the packer;

actuating means for actuating the valve in the packer after actuation of the locking means; and further comprising sealing means for sealingly closing said setting port after said setting operation.

28. A hydraulic setting tool for use in setting a packer in a well bore, the packer having a valve therein, said tool comprising:

hydraulic setting means for setting the packer in said well bore in response to relative movement between inner and outer portions of said hydraulic setting means;

mechanical locking means for preventing said relative movement after setting of the packer;

actuating means for actuating the valve in the packer after actuation of the locking means;

bypass means for bypassing fluid through the tool as the tool and packer are run into a well bore; and hydraulic valve means for closing the bypass means in response to a well annulus pressure.

* * * * *